US007872227B2

(12) United States Patent
Yamada et al.

(10) Patent No.: US 7,872,227 B2
(45) Date of Patent: Jan. 18, 2011

(54) MASS SPECTROMETER

(75) Inventors: Noriyuki Yamada, Tokyo (JP); Takeshi Nishijima, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 359 days.

(21) Appl. No.: 12/183,116

(22) Filed: Jul. 31, 2008

(65) Prior Publication Data

US 2009/0039251 A1 Feb. 12, 2009

(30) Foreign Application Priority Data

Aug. 9, 2007 (JP) ..... 2007-208177

(51) Int. Cl.
*H01J 49/00* (2006.01)

(52) U.S. Cl. ..... 250/288; 250/281; 250/282

(58) Field of Classification Search ..... 250/282, 250/281, 287, 288, 289, 396 R
See application file for complete search history.

(56) References Cited

U.S. PATENT DOCUMENTS 5,049,739 A * 9/1991 Okamoto ..... 250/281
5,381,008 A * 1/1995 Tanner et al. ..... 250/288
5,767,512 A 6/1998 Eiden et al.
6,157,030 A * 12/2000 Sakairi et al. ..... 250/292
6,259,091 B1 7/2001 Eiden et al.
6,265,717 B1 * 7/2001 Sakata et al. ..... 250/289
7,119,330 B2 * 10/2006 Kalinitchenko ..... 250/288
7,199,361 B2 * 4/2007 Bloomfield et al. ..... 250/282
7,202,470 B1 * 4/2007 Marriott ..... 250/281
7,230,232 B2 * 6/2007 Marriott ..... 250/281
7,329,863 B2 * 2/2008 Kalinitchenko ..... 250/288
7,339,163 B2 * 3/2008 Marriott ..... 250/281
2004/0056189 A1 * 3/2004 Tanner et al. ..... 250/287
2005/0269506 A1 * 12/2005 Kalinitchenko ..... 250/288
2006/0151690 A1 * 7/2006 Marriott ..... 250/288
2009/0266984 A1 * 10/2009 Hirano ..... 250/288

FOREIGN PATENT DOCUMENTS

JP 10-040857 2/1998

* cited by examiner

*Primary Examiner*—Nikita Wells
*Assistant Examiner*—Johnnie L Smith

(57) ABSTRACT

A side wall 35 that extends in the axial direction enclosing the plasma in such a way that expansion of plasma to the sides is prevented at the back surface of a skimmer cone 33 and a small collision chamber 36, which is positioned at the back side of this side wall 35 and is defined by a flat part 56 of a first electrode 53 having an opening 57 through which the ion beam can pass. By means of this small collision chamber 36, the pressure inside the chamber rises without introducing additional gas; therefore, argon ions are neutralized by collision and recombination between the ions and electrons and the ion density of the plasma is reduced. Thus, the beam diameter during ion extraction and transport is maintained relatively small.

16 Claims, 4 Drawing Sheets

| | Sensitivity of each ion [cps/ppb] | | | $^{38}$Ar ion intensity (Mcps) |
|---|---|---|---|---|
| | Li | Y | Tl | |
| Present invention | 24,500 | 115,000 | 50,000 | 10 |
| Comparative example | 15,000 | 58,500 | 21,700 | 15.6 |

MASS SPECTROMETER

This application claims priority from Japanese Patent Application No. JP 2007-208177 filed on 9 Aug. 2007, which is incorporated by reference in its entirety.

The disclosed embodiments relate to a plasma mass spectrometer for extracting an ion beam from plasma into which a sample to be analyzed has been introduced and performing an elemental analysis of the sample by mass spectrometry.

BACKGROUND

The plasma mass spectrometer is known as an analyzer for the highly sensitive analysis of inorganic elements. By means of this instrument, a sample to be analyzed that has been nebulized, converted to micro particles, etc. is introduced into plasma formed on a plasma torch, the elements contained in the sample are ionized, and then the ions in the plasma are extracted in the form of an ion beam and a mass spectrometric analysis of the sample is performed by detecting those ions. The plasma into which the sample is introduced is either an inductively coupled plasma (ICP) that is generated using as the energy source a high-frequency electromagnetic field provided from a coil near the plasma torch, or a microwave plasma produced by microwaves introduced into the tip of the plasma torch.

This instrument comprises an interface for sampling and then skimming a portion of the generated plasma. Usually this interface comprises two cone parts, a sampling cone and a skimmer cone. These cone parts have circular cone-shaped projections that face the plasma torch side, and there is a small orifice at the tip of these projections. A portion of the plasma formed on the plasma torch is sampled and then skimmed while passing through these small orifices and reaches the back side of the skimmer cone, which is disposed on the downstream side.

The ions present in the skimmed plasma are provided in the form of an ion beam by extraction electrodes positioned in the front part of an ion optical system. The extraction electrodes include an electrode set at negative potential and extract the positive ions in the plasma with the electric field formed by that electrode.

The extracted ions further pass through the ion optical system, that typically includes an ion deflection lens and an ion guide, and are introduced into the ion separation part behind the ion optical system. By means of the ion separation part, ions are selected and separated based on their mass-to-charge ratio such that only specific ions reach the detector behind the ion separation part. The ion separation part typically has a multi-electrode structure, such as a quadrupole.

In order to improve the analysis precision of this plasma mass spectrometer, there is a demand for the removal of the ions (interference ions) that interfere with other specific ions during mass spectrometric analysis. These interference ions are typically polyatomic ions that comprise multiple atoms including the element of the carrier gas.

This problem can be solved by inducing a collision/reaction effect with gas that is additionally introduced before the ions reach the ion separation part (JP (Kohyo) 2005-535071, JP (Kohyo) 2005-519450, JP (Kohyo) 11-509036). Since carrier gas that forms the primary component of the plasma is typically argon gas, the interference ions are polyatomic ions that contain argon atoms. These polyatomic ions are removed or decomposed and isolated from the ion beam by deceleration or a reaction such as charge transfer as a result of colliding with the molecules of the additional gas.

There are a variety of positions for the introduction of additional gas, such as inside the cone parts that form the interface (JP (Kohyo) 2005-535071), directly behind the interface (JP (Kohyo) 2005-519450 particularly the example in FIG. 4], JP (Kohyo) 11-509036), and inside the components that form the ion optical system (JP (Kohyo) 11-509036). The additional gas is typically hydrogen gas, helium gas, ammonia, argon, a mixed gas of several of these gases, and similar gases.

A second method for solving this problem is the method whereby the reduction of polyatomic ions is promoted by forming a region of relatively low vacuum, that is, relatively high pressure, during the course of skimming the plasma so as to cause the polyatomic ions to collide with the gas molecules in this region (JP (Kohyo) 2005-519450 [particularly the examples in FIGS. 2 and 3], JP (Kokai) [Unexamined Patent Publication] 10-40857). This region can have a portion having a relative small capacity inside the orifices in the cone parts forming the interface (JP (Kokai) [Unexamined Patent Publication] 10-40857) and a portion having a relatively large capacity directly behind the skimmer cone forming the interface (JP (Kokai) [Unexamined Patent Publication] 10-40857).

SUMMARY

There is a need for ion detection by plasma mass spectrometers of even higher sensitivity. In particular, there is a need for the analysis of high-matrix samples. The phrase "high-matrix sample" refers to samples containing high concentrations of metal salts and other water-soluble substances in addition to the elements to be measured. Sea water is a typical high-matrix sample.

In order to avoid problems such as the contamination of the inside of the mass spectrometer when analyzing a high-matrix sample, it is necessary to dilute the sample at least at a position upstream from the interface inside the mass spectrometer. This is because there is a problem in that when large amounts of matrix elements enter the inside of the mass spectrometer, they are deposited on the end of the plasma torch, etc. and cause errors in the analytical results, or they are deposited around the orifices in the cone parts that form the interface and block these orifices, interrupting analysis. When analysis is accompanied by a dilution process, it is assumed that reduced amount of elemental ions are available for detection; therefore, improvements for guaranteeing the necessary sensitivity are desired.

The applicants proposed a mass spectrometer with which many parameters, including the mass flow of the carrier gas, are controlled and a high-matrix sample can be analyzed by direct introduction into the mass spectrometer without being diluted, and they previously filed an application to patent this invention as JP (Tokugan) 2006-219520. By means of this invention, it is possible to continuously analyze samples of various matrix concentrations with good repeatability and without problems such as contamination of the inside of the mass spectrometer, by selecting the appropriate set of parameters based on the sample to be analyzed from the plural sets of parameters prepared in accordance with matrix concentration levels.

By means of the invention in the application in question, as one of the parameters in each parameter set, the mass flow of the carrier gas is set at a lower value as the matrix concentration of the sample increases. Moreover, the parameter values in each parameter set are chosen within the range of high plasma temperature. Under such circumstances, the efficiency of ionizing the primary elements that form the plasma (such as argon) increases and a plasma having relatively high electron and ion densities is formed.

When ions are extracted from this plasma having a high density, relatively strong Coulomb interaction is generated between the ions. Consequently, when an ion beam is formed from this plasma by an extraction electrode part, the beam diameter becomes lager due to Coulomb interaction, the ion transmission efficiency deteriorates, fewer ions of the elements can reach the ion separation part, and the sensitivity therefore decreases.

When additional gas is reacted with the plasma in the vicinity of the interface as with the above-mentioned prior art (Patent References 1, 2, and 3), the effect of reducing the overall ion density of the plasma is small, even if the additional gas molecules react with the ions that form the plasma, and more of the ions of the sample to be analyzed are unintentionally reduced and the analysis sensitivity decreases.

Moreover, means for reducing the degree of vacuum (increasing the pressure) on the inside of the orifices in the cone parts that form the interface (Patent Reference 4) intend to simultaneously cause the ions and electrons to collide and recombine, but the very small capacity of the space used for collision make it difficult to control the pressure in such way that the ion density of the plasma is reduced and that the number of ions to be detected is maintained at the same time.

The ions and electrons might collide/recombine in a collision space having a relatively large capacity directly behind the skimmer cone that forms the interface (Patent Reference 2), but because the extracting position of the ion beam is within the collision space, there is relatively little chance that the analyte ions will pass through the collision space and as a result, there will be an increase in the number of analyte ions that are unintentionally lost and the sensitivity will be compromised.

Consequently, an object of the disclosed embodiments is to improve the sensitivity of a plasma mass spectrometer. In particular, an object of the disclosed embodiments is to improve the sensitivity by reducing the ion density of the plasma introduced through the interface and increasing the number of analyte ions that are contained in the ion beam.

In order to solve the above-mentioned problems, using the disclosed embodiments, some of the argon ions are neutralized and the ion density of the skimmed plasma is reduced before the ion beam is formed. The applicant discovered that by confining the plasma introduced via the interface to a relatively small chamber in comparison to the capacity between the conventional interface and the conventional extraction electrode part, it is possible to reduce the argon ions by a larger proportion without greatly reducing the number of analyte ions. This apparently is because, by promoting collisions between ions and electrons with the skimmed plasma in a state of slightly reduced temperature, the argon ions, which have a higher ionization energy than the analyte ions, can be selectively neutralized.

That is, the disclosed embodiments provide a plasma mass spectrometer comprising a plasma generating part for generating argon gas plasma into which a sample to be analyzed will be introduced, an interface that faces the generated plasma and that is used for sampling and then skimming a portion of the plasma, and an extraction electrode part that is used for producing an ion beam behind the interface under reduced pressure from the skimmed plasma, this plasma mass spectrometer is characterized in that a small collision chamber which is disposed between the interface and the extraction electrode part and is defined with a side wall which extends in an axial direction as it encloses the plasma in such a way that the expansion of the skimmed plasma gas in the radial direction is restricted and with a flat electrode plate which is positioned behind the side wall at a distance capable of being reached by the skimmed plasma and has an opening through which the plasma or the ion beam can pass such that the pressure is raised without introducing additional gas, and the argon ions in the skimmed plasma are neutralized by a colliding and/or reacting effect caused by confinement in the small collision chamber and the ion density of the plasma is reduced.

In one example, the side wall for preventing the plasma from expanding in the radial direction can be formed by extending backward the skimmer cone accessory, which is a part of the interface. In this case, the side wall has a continuous interior surface and a small collision chamber having a projectile-shaped space is disposed on the interior side of the side wall.

By means of another example, a portion of the side wall can be formed by an insulator. Quartz can be selected for the insulator, for example. An open space for the small collision chamber is guaranteed by anchoring a quartz cylinder at a predetermined position on the back surface of the interface and away from the orifices. It should be noted but when a part of the side wall is formed from an insulator, the interior surface of the side wall of the small collision chamber can be a non-continuous surface part which has steps, but when the shape of the back surface of the interface is a shape that complements this insulator, it can be a virtually continuous surface. Moreover, the interior surface of the cylinder formed from an insulator is not necessarily parallel in the axial direction of the plasma current; it can become larger in diameter, or vice-versa, it can become smaller in diameter, from the front to the back.

In addition to the above-mentioned examples, the small collision chamber formed by a variety of methods can have an open space positioned at the tip where the plasma is skimmed behind the skimmer cone, which is a part of the interface, that is, away from the orifices, and limited to a diameter of 2.0 mm to 4.0 mm, preferably 2.5 to 3.5 mm, and a length of 2.0 mm to 3.0 mm. The electrode plate that defines the back end of the open space is positioned at a distance of 4.0 to 7.0 mm, preferably 5.0 to 6.0 mm, away from the orifice in the skimmer cone in an axial direction. As previously mentioned, the small collision chamber can have a projectile shape or a shape similar to a projectile shape, but it is not restricted to such a shape.

The back end of the small collision chamber can be defined by a flat electrode plate that has electrical conductivity. This electrode plate can form a portion of the extraction electrode for forming an ion beam from the skimmed plasma. In order to extract ions from the plasma behind the electrode plate, usually the electrode plate is at ground potential, or a relatively low positive or negative potential. The gap between the electrode plate and the side wall enclosing the plasma from the sides is 1 mm or smaller, and the pressure-reducing effect is controlled such that there is no reduction in pressure inside the small collision chamber. The electrode plate can be positioned in an axial direction at a distance closer than 6.0 mm, for instance, 5.0 mm or 5.5 mm, away from the orifice at the back of the interface through which a portion of the plasma is skimmed and passes, that is, the orifice in the skimmer cone.

The plasma mass spectrometer can have a collision/reaction cell that is used for introducing additional gas and inducing collisions and/or reactions with the ions and is disposed behind the extraction electrode part that is found at a distance from the small collision chamber. The collision or reaction with the additional gas is to reduce the number of interference ions including argon ion, which is the primary carrier gas element. The additional gas can be hydrogen, helium, ammonium, argon, a mixture of several of these gases, and the like. By reducing the ion density of the plasma in front, that is, upstream, of the collision/reaction cell in the disclosed embodiments, a relatively large number of analyte ions can be taken up in the ion beam and sensitivity can therefore be guaranteed.

The disclosed embodiments further provide a plasma mass spectrometer comprising a plasma generating part for generating argon gas plasma into which a sample to be analyzed will be introduced, an interface that faces the generated plasma and that is used for sampling and then skimming a portion of the plasma, and an extraction electrode part that is found behind the interface and that is used for producing an ion beam under reduced pressure from the skimmed plasma, this plasma mass spectrometer is characterized in that a small collision chamber which is disposed between the interface and the extraction electrode part and is defined with a side wall which encloses around the sides of the skimmed plasma and with an electrode plate which is positioned near the back end of the side wall at a distance capable of being reached by the skimmed plasma and has an opening through which the plasma or the ion beam can pass and the gap between the back end of the side wall and the electrode plate is made to be 1 mm or smaller such that evacuation of the small collision chamber is restricted to control the pressure reduction in the chamber, and the argon ions in the skimmed plasma are neutralized by a colliding and/or reacting effect caused by confinement in the small collision chamber and the ion density of the plasma is reduced.

That is, by means of the disclosed embodiments, regardless of the shape of the side wall for defining the small collision chamber, by making the gap between the back end of the side wall and the electrode plate that defines the back end of the small collision chamber narrow at 1 mm or smaller, evacuation is restricted such that there is no reduction in pressure inside the small collision chamber. This gap can be 0.5 mm or smaller. That is, the shape of the small collision chamber defined by the side wall and the electrode plate can be projectile-shaped or circular cylindrical-shaped.

By means of the disclosed embodiments, as with the previous disclosed embodiments, the electrode plate can form a portion of the extraction electrode for forming an ion beam from the skimmed plasma. The plasma mass spectrometer can also have a collision/reaction cell for introducing additional gas and inducing collisions and/or reactions with the ions at a position behind the extraction electrode part that is away from the small collision chamber. The electrode plate can be positioned in an axial direction at a distance closer than 6.0 mm, for instance, 5.0 mm or 5.5 mm, away from the small orifice at the back of the interface through which a portion of the plasma is skimmed and passes, that is, the orifice in the skimmer cone.

By means of the plasma mass spectrometer of the disclosed embodiments, it is possible to promote collisions primarily between the ions and electrons and selectively neutralize the ions of argon, which is the primary component of the plasma, by confining the skimmed plasma to a small collision chamber having a relatively small capacity while still in a plasma state and it is therefore possible to effectively prevent the ion beam from spreading at the extraction electrode part or behind that part due to an increase in ion density. Consequently, a relatively high-sensitivity analysis becomes possible, and it is possible to maintain sufficient sensitivity, even when an analysis that is accompanied by sample dilution is performed, as with high-matrix sample analysis.

In particular, by means of the analyzer of the disclosed embodiments, a reduction in the argon ions contained in the plasma can be expected and the loss of analyte ions when the ion beam is extracted is very small as a result of inducing collisions between ions and electrons while maintaining a stable flow of neutrals, ions, and electrons extracted from the plasma in a small collision space.

DETAILED DESCRIPTION

Figure 1:
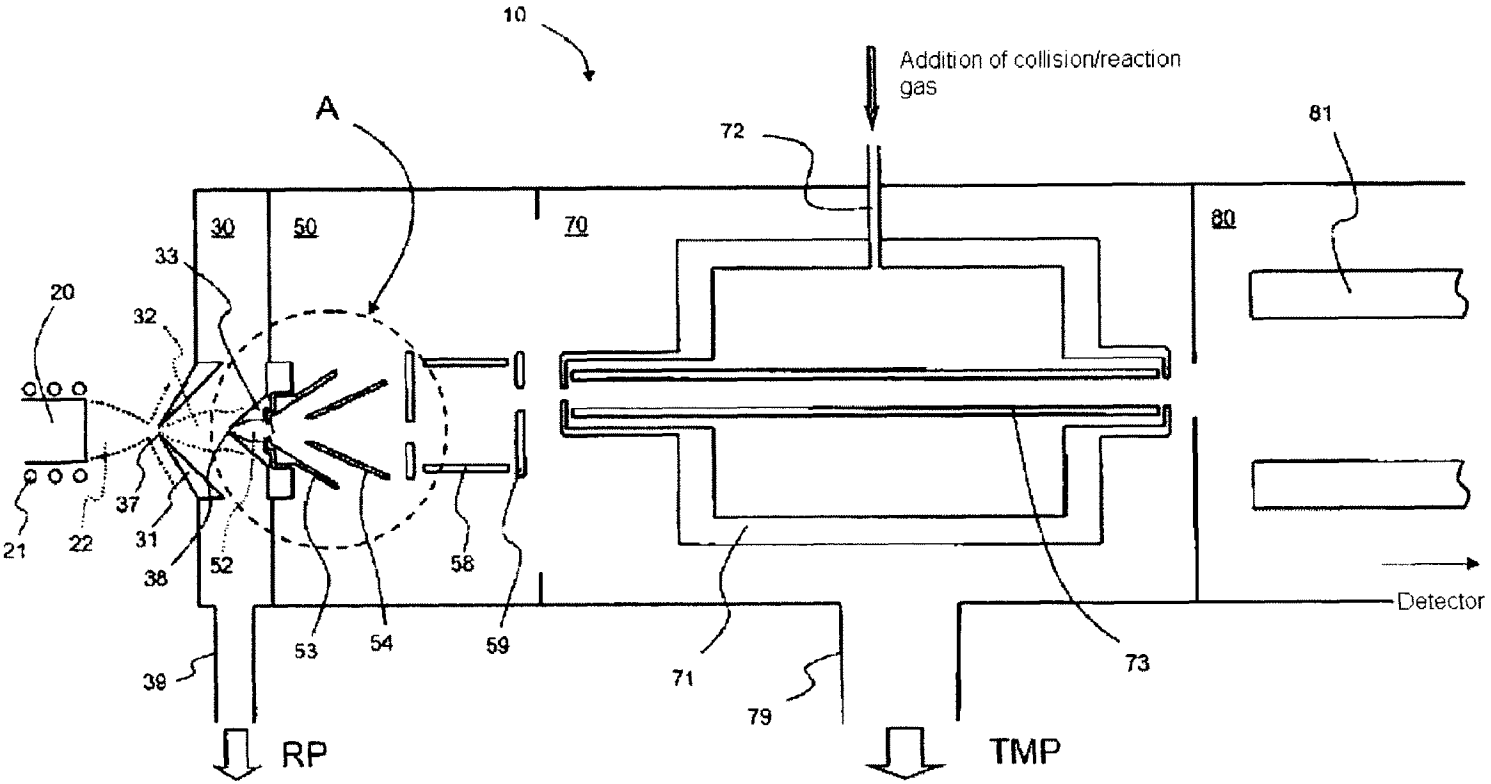
FIG. 1 is a drawing showing the schematic structure of a portion of an inductively coupled plasma mass spectrometer that is an example of the disclosed embodiments.
Figure 2:
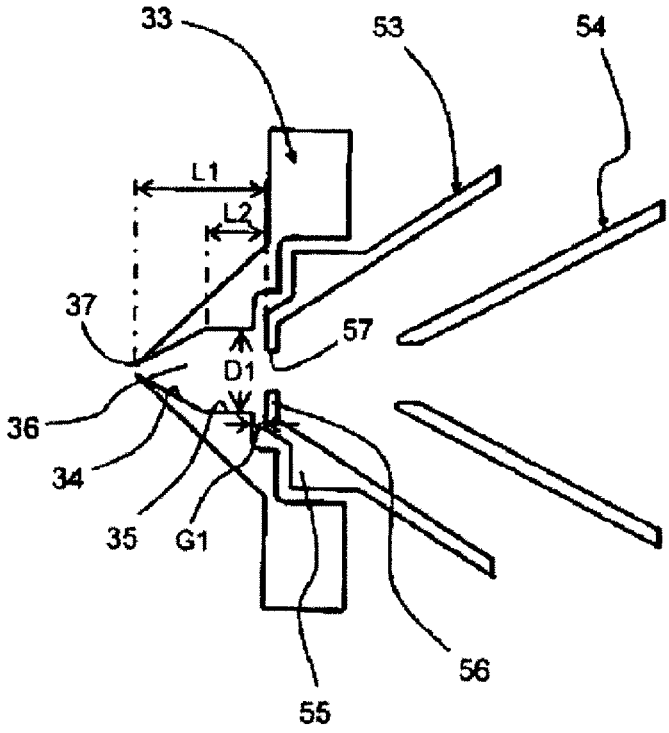
FIG. 2 is a drawing showing the structure that serves as the first embodiment of a characterizing feature of the disclosed embodiments.
Figure 3:
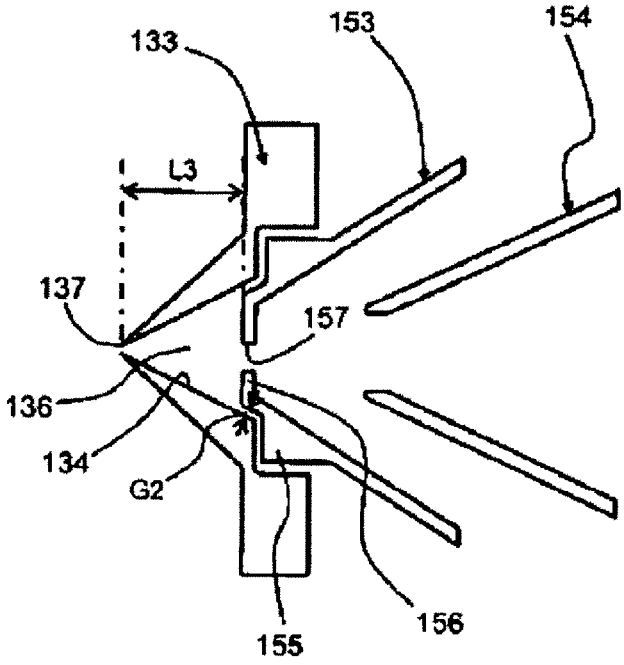
FIG. 3 is a drawing showing the structure that serves as the second embodiment of a characterizing feature of the disclosed embodiments.
Figure 4:
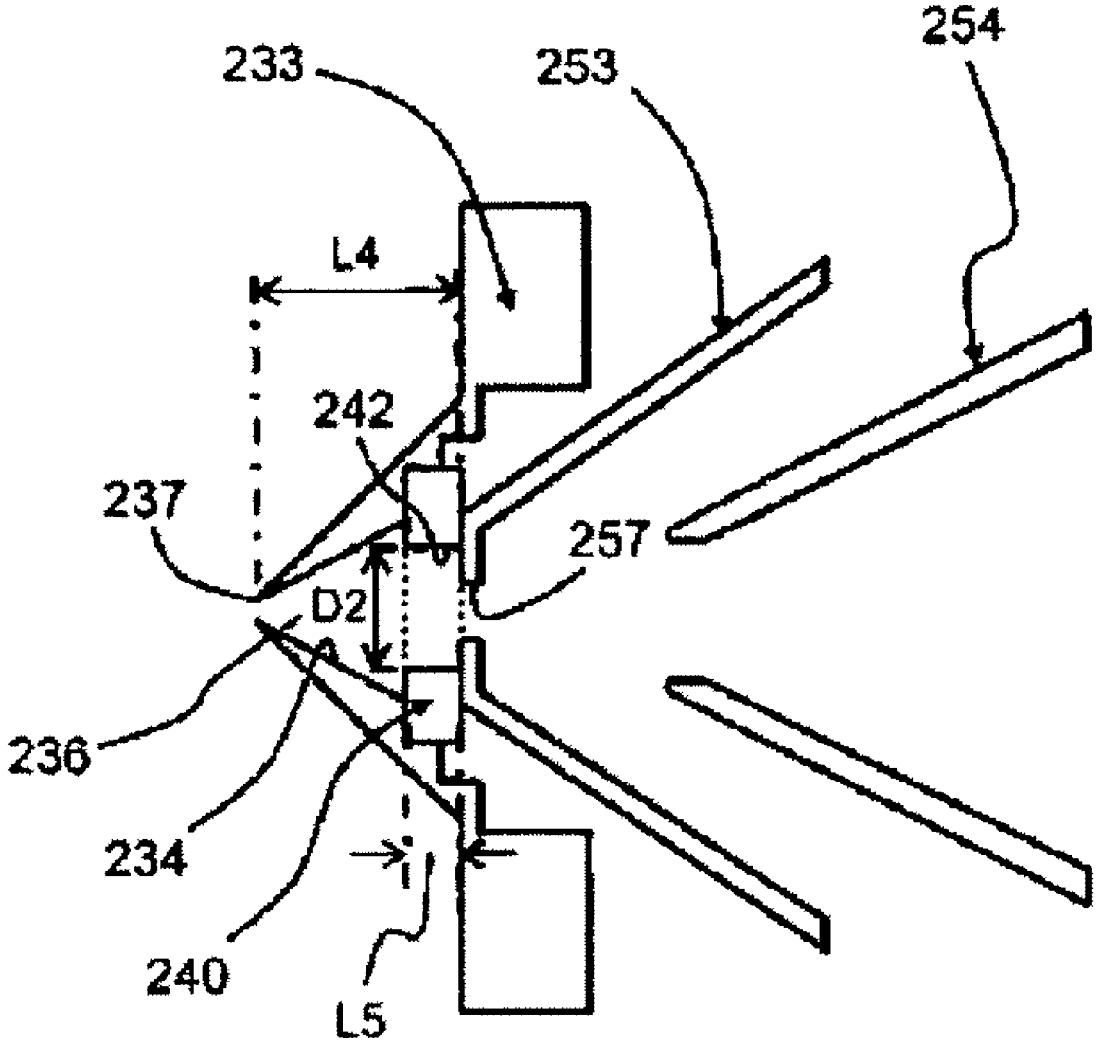
FIG. 4 is a drawing showing the structure that serves as the third embodiment of a characterizing feature of the disclosed embodiments.
Figures 5, 6:
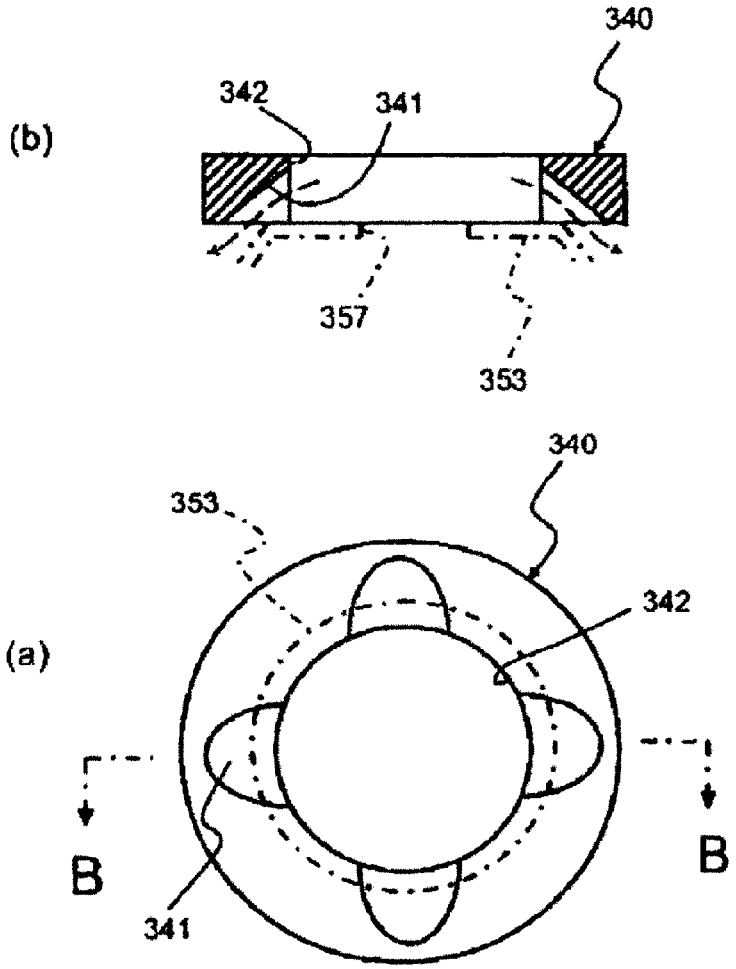
FIG. 5 is a drawing showing an example wherein the shape of the insulator used in the analyzer in FIG. 4 is changed, and (a) is the back surface view and (b) is the cross section along line B-B in (a).
FIG. 6 is a drawing showing the results of a comparison of an analyzer improved by the disclosed embodiments and an unimproved analyzer.

Preferred embodiments will be described in detail while referring to the attached drawings. FIG. 1 is a drawing showing the schematic structure of a portion of an inductively coupled plasma mass spectrometer (simply analyzer hereafter), which is an example of the disclosed embodiments. FIG. 2 is a drawing showing the structure of a first embodiment, FIG. 3 is a drawing showing the structure of a second embodiment, and FIG. 4 is a drawing showing the structure of a third embodiment. FIG. 5 is a drawing showing a modification of the ring-shaped insulator used in the analyzer in FIG. 4, with (a) being the back view and (b) being the B-B cross section of (a). FIG. 6 is a table showing the results of a comparison of an analyzer improved by the disclosed embodiments and an unimproved analyzer. It should be noted that although FIGS. 1 through 4 are cross sections, they have a three-dimensional structure that forms on almost tubular shape extending in the axial direction.

FIG. 1 is the structure of a part of an analyzer for plasma mass spectrometry. Analyzer 10 comprises a plasma torch 20 for producing a plasma 22; an interface part 30 positioned facing plasma 22; an ion lens part 50 positioned behind interface 30; an ion guide part 70 positioned behind ion lens part 50; and an ion separation part 80 positioned behind ion guide part 70.

A coil 21 for generating a high-frequency electromagnetic field near the tip of plasma torch 20 is disposed at this tip. A gas flow is produced from the back end to the front end inside plasma torch 20; therefore, plasma 22 is shaped such that it stretches toward interface part 30.

Two cone members, a sampling cone 31 and a skimmer cone 33, are disposed at interface part 30. A part 32 of the plasma that has passed through an orifice 37 of sampling cone 31, which faces plasma 22 directly, reaches skimmer cone 33 disposed farther back. The plasma portion 32 passes through an orifice 38 formed in skimmer cone 33 and reaches the back. This plasma is represented by reference 52 in the drawing. It should be noted that the gas molecules that cannot pass through the skimmer cone 33 (including neutralized ions) are evacuated from interface part 30 via an evacuation port 39 via an oil-sealed rotary pump RP.

A first electrode 53 and a second electrode 54 that form the extraction electrode part and horizontal electrodes 58 and vertical electrodes 59 at the front and back of the horizontal electrodes, forming the ion deflection lens, are disposed at ion lens part 50. Second electrode 54 forming the extraction electrode part is brought to negative potential; therefore, only positive ions are extracted from plasma 52 in the form of an ion beam. The ion beam is guided through the ion deflection lens at the back to the inside of a cell 71 of ion guide part 70 disposed at the back. The characterizing feature of the structure of the disclosed embodiments is the part shown by broken line A in the drawing, particularly the structure of the extraction electrode part beginning at the back of skimmer cone 33, and the details are described latter. It should be noted that although first electrode 53 can be brought to any potential, typically it is at ground potential.

The ions guided to cell 71 are guided to the back following the trajectories determined by the electric field generated by a multi-pole electrode 73. Multi-pole electrode 73, for instance, has an octapole structure. Moreover, collision/reaction gas is introduced from an inlet 72 to the inside of cell 71. The molecules of the introduced gas have the effect of producing a collision or a reaction that is accompanied by charge transfer with the various interference ions in the ion beam and decomposing or eliminating from the ion beam the polyatomic ions containing the argon atoms used as carrier gas or plasma gas.

It should be noted that when analyzer 10 is operating, ion guide part 70 is evacuated together with ion lens part 50 using a turbomolecular pump (TMP). Consequently, although contained in plasma 52, the neutralized molecules inside ion lens part 50 or ion guide part 70 or the molecules of collision/reaction gas introduced to inside the cell are evacuated from an evacuation port 79.

The ion beam guided through cell 71 is introduced to an ion separation part 80. A multipole structure 81, which is a quadrupole typically, is used inside ion separation part 80. The ions in the ion beam are separated based on the mass-to-charge ratio by the electrical field generated by the multipole structure and guided to a detector at the back (not illustrated) and detected.

FIG. 2 shows an enlargement of the part shown by broken line A in FIG. 1. The characterizing feature in this embodiment is the formation of a virtually projectile-shaped small-capacity chamber (or small collision chamber) 36 between the back surface of skimmer cone 33 and first electrode 53. The back surface of skimmer cone 33 has a first part 34 having an inclined surface and a second part 35 that forms a virtually circular cylinder internal surface disposed behind part 34. Moreover, first electrode 53 disposed directly behind skimmer cone 33 optionally has a flat part 56 that is perpendicular to the axial direction and a protrusion part 55 having a right-angled triangular shape that forms a complimentary shape to skimmer cone 33. That is, the above-mentioned small-capacity chamber 36 is defined by the back surface of skimmer cone 33 and flat part 56 of first electrode 53. It should be noted that an opening 57 through which an ion beam or plasma can pass is formed in flat part 56. Opening 57 has a diameter of 1.5 to 3.0 mm, preferably 2.0 mm. Moreover, second part 35 optionally has a shape whose diameter becomes somewhat larger toward the back.

The length of small-capacity chamber 36 (L1) is between 4.0 mm and 7.0 mm, preferably between 5.0 mm and 6.0 mm (for instance, 5.5 mm). This is defined as the dimension by which a portion of the plasma that has passed through orifice 37 of the skimmer cone 33 can reach first electrode 53 that defines the back end of small-capacity chamber 36. Moreover, the diameter (D1) of second part 35 is between 2.0 mm and 4.0 mm, preferably between 3.0 mm and 3.5 mm, for instance, 3.2 mm, and the length in the axial direction (L2) is between 1.5 mm and 3.0 mm, for instance, 2.0 mm. Second part 35 is formed at a position away from orifice 37 of skimmer cone 32 where the ions or electrons that form a portion of the plasma that has passed through orifice 37 have been cooled to a certain extent. Expansion of the plasma gas that has passed through orifice 37 of skimmer cone 33 in the radial direction is prevented by the presence of second part 35.

As illustrated, a narrow gap (G1) is formed between skimmer cone 33 and first electrode 53. G1 has a dimension of 1 mm or smaller, preferably 0.5 mm. As described above, ion lens part 50 is evacuated under reduced pressure by a turbo molecular pump (TMP), but an excessive pressure reduction of small-capacity chamber 36 is prevented by giving a small dimension to the gap G1 through which gas molecules pass.

The characterizing point of the disclosed embodiments is that collision and recombination between the ions and electrons that form the plasma is promoted inside this small-capacity chamber 36 and the ions are thereby neutralized. Small-capacity chamber 36 controls this pressure-reducing effect, as previously explained. On the other hand, a portion of plasma is usually introduced for analysis; therefore, although the inside of small-capacity chamber 36 is reduced in pressure, it is still in a state of relatively high pressure. Because of this high pressure, there is an increase in the incidence of collision and recombination between ions and electrons and neutralization of the ions is promoted.

In this case, neutralization of the argon ions that are derived from the carrier gas or plasma gas proceeds more efficiently than does neutralization of the analyte ions. This is explained by the fact that the incidence of collision and recombination increases because there are more argon ions and there is a tendency toward neutralization being promoted because the argon ions are in a relatively unstable ionized state.

As a result of this type of selective collision and recombination effect, the ion density of the plasma inside small-capacity chamber 36 can be reduced. Therefore, it is possible to keep relatively small the increase in diameter that is associated with Coulomb repulsion of the ion beam extracted by second electrode 54, and to increase the ion transmission efficiency. As previously mentioned, the neutralizing effect of collision and recombination inside small-capacity chamber 36 has an advantage in that it is selective and there is therefore not a large reduction in the number of analyte ions in the ion beam.

FIG. 3 is similar to FIG. 2, but shows an analyzer of a different embodiment. The components that have the same effect as in the above-mentioned embodiment are represented by the number 100 added to the same reference number and a description is therefore omitted. The characterizing point of this embodiment is that an extended inclined surface 134 is formed without breaking and bending the back surface of skimmer cone 133, and a small-capacity chamber 136 having a circular cylindrical shape is formed between a flat part 156 of a first electrode 153 [and inclined surface 134]. As illustrated, flat part 156 is disposed so that it partially overlaps with the back part of inclined surface 134 and a gap G2 is defined as a result. The length (L3) of small-capacity chamber 136 is selected as the distance that can be reached by the plasma that passes through an orifice 137 of a skimmer cone 133.

By means of the present embodiment, when compared to the embodiment shown in FIG. 2, there is no wall that suppresses the plasma gas in the radial direction such as second part 35, but by making gap G2 between skimmer cone 133 and first electrode 153 narrow at for instance, 1 mm, or 0.5 mm, or less than 0.5 mm, it is possible to keep the inside of small-capacity chamber 136 at a relatively high pressure. As a result, collision and recombination between ions and electrons can be promoted and, as in the above-mentioned embodiment, the ion density of the plasma can be reduced by selectively neutralizing the argon ions. It should be noted that in the example in FIG. 3, the position of an opening 157 is offset down from the center of the axis. When combined with the ion deflection lens in the back, this structure prevents the passage of photons, and has been used in the past. The diameter of opening 157 can be virtually the same as in the embodiment in FIG. 2.

FIG. 4 is a drawing similar to FIGS. 2 and 3, but shows the analyzer of a different embodiment. The components that have the same effect as in the above-mentioned embodiment are represented by the number 200 added to the same reference number and a description is therefore omitted. The characterizing point of this embodiment is that a ring member 240 of an insulator is disposed at a back surface 234 of a skimmer cone 233, and a small-capacity chamber 236 is formed by this back surface 234 and ring member 240. The length (L4) of small-capacity chamber 236 is selected as the distance that the plasma which passes through an orifice 237 of skimmer cone 233 is capable of reaching.

The inner diameter D2 of ring member 240 is between 2.0 mm and 3.5 mm, for instance, 3.0 mm, and the depth (L5) of the ring member is between 1.0 mm and 2.5 mm, for instance, 1.5 mm. Ring member 240 can be anchored by being sandwiched between skimmer cone 233 and a flat part 257 of a first electrode 253. Moreover, ring member 240 is positioned away from orifice 237 of skimmer cone 233.

According to the embodiment in FIG. 4, evacuation for reducing the pressure of small-capacity chamber 236 is performed only through opening 257 through which the ion beam or plasma passes. Consequently, the pressure inside small-capacity chamber 236 is relatively high, and as in the previous embodiments, the probability of collision between ions and electrons is increased and as a result, an effect of selective neutralization of argon ions is produced. The present embodiment has an advantage in that the working of skimmer cone 233 and the assembly of the parts are facilitated. It should be noted that by means of the present embodiment, the interior surface of ring member 240 has a virtually cylindrical interior surface shape and can be a variety of shapes, such as a shape wherein the inner diameter becomes larger or smaller toward the back, or a shape wherein there are steps, such as a shape having an inner diameter that becomes larger or smaller moving along the interior surface. However, when the path of the gas flow is defined only by an opening 242 disposed in the wall that determines the back end of the collision space and by an opening 257, there is a chance that it will not be possible to optimally control collision incidence. Therefore, a modified example such as described below can also be used.

FIG. 5 shows a modification of ring member 240 used in the embodiment in FIG. 4. A ring member 340, which is shown as this modification, has multiple (four in the drawing) grooves 341 formed along the back surface. Reference 353 in the drawing virtually shows the position of a first electrode. The arrows in the drawing show the gas flow that passes through grooves 341. That is, when ring member 240 is used, the evacuation of small-capacity chamber 236 can be performed along the path formed by openings 342 and 357, as well as from a position around the outside of these openings using grooves 341. This structure is effective for optimizing the incidence of collisions in small-capacity chamber 236. For example, it is also possible to use multiple types of ring members having grooves of various dimensions interchangeably in accordance with various conditions.

FIG. 6 shows an example of the results of measurements by an analyzer having the structure of the embodiment in FIG. 2. By way of comparison, it also shows the results of measurements using an analyzer having a skimmer cone wherein the back surface extends inclined without any curvature between the orifice through which plasma will pass and near the first electrode immediately behind the skimmer cone when the gap between the skimmer cone and the first electrode is 1.5 mm, that is, when the pressure between the skimmer cone and the first electrode is relatively low.

As shown in the Table, as a result of the disclosed embodiments, the amount detected (that is, the signal intensity) of analyte ions is relatively large in comparison to the amount of argon ions detected. That is, by modifying the structure of the prior art, or the comparative example, to the structure of the disclosed embodiments, the amount of argon ions can be reduced and the sensitivity for elements of the sample to be analyzed can be enhanced. This is apparently because, by means of the disclosed embodiments, it is possible to produce ions from plasma and further prevent the ion beam diameter from increasing as the ions are transported toward the back, and it is possible to efficiently guide the analyte ions to the ion separation part.

The structure and effect of analyzers that are preferred embodiments were described in detail, but it goes without saying that these are only examples, and the disclosed embodiments are not limited to these descriptions. That is, various changes and modifications can be made to these embodiments by persons skilled in the art.

The reference numbers used in the drawings include the following:

10 Inductively coupled plasma mass spectrometer
20 Plasma torch
22, 32, 52 Plasma
30 Interface part
31 Sampling cone
33, 133, 233 Skimmer cone
36, 136, 236 Small-capacity chamber (small collision chamber)
50 Ion lens part
53, 153, 253 First electrode
54, 154, 254 Second electrode
56, 156, 256 Flat part (electrode plate)
70 Ion guide part
71 Cell
80 Ion separation part
240, 340 Ring member

The invention claimed is:

1. A plasma mass spectrometer comprising:

a plasma generating part for generating argon gas plasma into which a sample to be analyzed will be introduced, an interface that faces the generated plasma and that is used for sampling and then skimming a portion of the plasma, and an extraction electrode part that is found behind the interface and that is used for producing an ion beam behind the interface under reduced pressure from the skimmed plasma, said plasma mass spectrometer characterized in that a small collision chamber which is disposed between the interface and the extraction electrode part and is defined with a side wall which extends in an axial direction as it encloses the plasma in such a way that the expansion of the skimmed plasma to the side is restricted and with a flat electrode plate which is positioned behind the side wall at a distance capable of being reached by the skimmed plasma and has an opening through which the ion beam or plasma can pass such that the pressure is raised without introducing additional gas, and the argon ions in the extracted plasma are neutralized by a colliding and/or reacting effect caused by confinement in the small collision chamber and the ion density of the plasma is reduced.

2. The plasma mass spectrometer according to claim 1, further characterized in that the side wall is formed by backward extension of a portion of the interface such that the small collision chamber has a projectile-shaped space on the interior side of the side wall.

3. The mass spectrometer according to claim 1, further characterized in that at the back end of the small collision chamber the gap between the side wall and the electrode plate has a dimension of 1 mm or smaller such that the pressure-reducing effect inside the small collision chamber is controlled.

4. The plasma mass spectrometer according to claim 3, further characterized in that the gap has a dimension of 0.5 mm or smaller.

5. The plasma mass spectrometer according to claim 1, further characterized in that at least a portion of the side wall is formed by an insulator.

6. The plasma mass spectrometer according to claim 5, further characterized in that at least a portion of the side wall is formed by a quartz cylinder.

7. The plasma mass spectrometer according to claim 1, further characterized in that, at a position away from the end where the plasma is skimmed, the small collision chamber contains a collision space limited to a diameter of 3 mm to 4 mm and a length of 2 mm to 3 mm.

8. The plasma mass spectrometer according to claim 1, further characterized in that the electrode plate is positioned a distance of 6 mm or less in the axial direction away from an orifice at the back of the interface through which the plasma is skimmed and passes.

9. The plasma mass spectrometer according to claim 1, further characterized in that an electrode plate forms the front end portion of the extraction electrode part.

10. The plasma mass spectrometer according to claim 1, further characterized in that the electrode plate is brought to ground potential.

11. The plasma mass spectrometer according to claim 1, further characterized in that a collision/reaction cell for introducing additional gas that will collide or react with the ion beam is disposed at a position that is away from the small collision chamber and farther back than the extraction electrode part.

12. A plasma mass spectrometer comprising:

a plasma generating part for generating argon gas plasma into which a sample to be analyzed will be introduced, an interface that faces the generated plasma and that is used for sampling and then skimming a portion of the plasma, and an extraction electrode part that is found behind the interface and that is used for producing an ion beam under reduced pressure from the skimmed plasma, said plasma mass spectrometer characterized in that a small collision chamber which is disposed between the interface and the extraction electrode part and is defined a side wall which encloses around the sides of the skimmed plasma and, with an electrode plate which is positioned near the back end of the side wall at a distance capable of being reached by the skimmed plasma and has an opening through which the ion beam can pass and the space between the side wall and the electrode plate is 1 mm or smaller such that evacuation restricted and the internal pressure-reducing effect is controlled, and the argon ions in the skimmed plasma are neutralized by a colliding and/or reacting effect caused by confinement in the small collision chamber and the ion density of the plasma is reduced.

13. The plasma mass spectrometer according to claim 12, further characterized in that the electrode plate forms the front end of the extraction electrode part and is brought to ground potential.

14. The plasma mass spectrometer according to claim 12, further characterized in that the gap has a dimension of 0.5 mm or smaller.

15. The plasma mass spectrometer according to claim 12, further characterized in that a collision/reaction cell for introducing additional gas that will collide or react with the ion beam is disposed at a position that is away from the small collision chamber and farther back than the extraction electrode part.

16. The plasma mass spectrometer according to claim 12, further characterized in that the electrode plate is positioned at a distance that is closer than 6 mm in an axial direction from an orifice at the back of the interface through which the plasma is skimmed and passes.

* * * * *